US007302209B2

(12) United States Patent
Kurita

(10) Patent No.: US 7,302,209 B2
(45) Date of Patent: Nov. 27, 2007

(54) IMAGE FORMING APPARATUS FACILITATING REMOVAL OF RECORDING MATERIAL FROM OPENING/CLOSING PORTION

(75) Inventor: Shigeharu Kurita, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 67 days.

(21) Appl. No.: 11/166,101

(22) Filed: Jun. 27, 2005

(65) Prior Publication Data

US 2006/0002738 A1 Jan. 5, 2006

(30) Foreign Application Priority Data

Jun. 30, 2004 (JP) ..... 2004-192778

(51) Int. Cl.
*G03G 21/00* (2006.01)
*G03G 15/08* (2006.01)
*G03G 15/16* (2006.01)

(52) U.S. Cl. ..... 399/124; 399/121; 399/122

(58) Field of Classification Search ..... 399/21, 399/121, 122, 124, 125
See application file for complete search history.

(56) References Cited

U.S. PATENT DOCUMENTS 4,696,561 A * 9/1987 Katoh et al. ..... 399/122
5,708,926 A * 1/1998 Sagara et al. ..... 399/122
5,787,326 A * 7/1998 Ogawa et al. ..... 399/124
5,826,141 A * 10/1998 Mitsuya ..... 399/122
5,956,547 A * 9/1999 Kamei et al. ..... 399/122
6,571,074 B2 * 5/2003 Suzuki et al. ..... 399/124
6,647,223 B2 * 11/2003 Ishii ..... 399/124 X
6,799,011 B2 9/2004 Abe et al. ..... 399/299
6,862,421 B2 3/2005 Choi ..... 399/302
6,996,354 B2 * 2/2006 Kimura et al. ..... 399/121
7,020,415 B2 * 3/2006 Abe ..... 399/121 X
2003/0086732 A1 5/2003 Abe et al. ..... 399/299
2003/0235430 A1 12/2003 Koshida ..... 399/124
2004/0013452 A1 1/2004 Choi ..... 399/313

FOREIGN PATENT DOCUMENTS

JP 9-292811 11/1997

(Continued)

*Primary Examiner*—Sandra L. Brase
(74) *Attorney, Agent, or Firm*—Fitzpatrick, Cella, Harper & Scinto

(57) ABSTRACT

An image forming apparatus according to the present invention includes: an image bearing member; a toner image forming portion for forming a toner image on the image bearing member; a transferring portion provided in a main body of the image forming apparatus and adapted to come into contact with the image bearing member in a transfer region, for transferring the toner image on the image bearing member to a recording material; a fixing portion for fixing the toner image to the recording material in a fixing region while nipping the recording material; an opening/closing portion which can be opened and closed with respect to the main body and which is provided with the fixing portion, the opening/closing portion allowing the recording material staying between the transfer region and the fixing region to be removed from the image forming apparatus when the opening/closing portion is in an open state and causing the fixing portion to move through opening and closing of the opening/closing portion; and a separating portion for, when the opening/closing portion is opened, separating the transferring means, which is in contact with the image bearing member, from the image bearing member.

2 Claims, 8 Drawing Sheets

FOREIGN PATENT DOCUMENTS

| | | |
|---|---|---|
| JP | 2000-221847 | 8/2000 |
| JP | 2001-249522 | 9/2001 |
| JP | 2002-357942 | 12/2002 |
| JP | 2003-156984 | 5/2003 |
| JP | 2004-29211 | 1/2004 |
| JP | 2004-54282 | 2/2004 |

* cited by examiner

IMAGE FORMING APPARATUS FACILITATING REMOVAL OF RECORDING MATERIAL FROM OPENING/CLOSING PORTION

BACKGROUND OF THE INVENTION

1. Field of the Invention

The present invention relates to the arrangement of transferring means, fixing means, etc. of an electrophotographic image forming apparatus.

2. Related Background Art

Recently, there is a demand for an image forming apparatus allowing easy removal of any staying recording material when jamming has occurred.

To meet this demand, there is provided an opening/closing portion capable of being opened and closed with respect to the main body of an image forming apparatus. Any recording material staying between transferring means for transferring a toner image on an image bearing member to a recording material in a transfer region and fixing means for effecting fixing while nipping the recording material in a fixing region, is removed from the opening/closing portion. Due to this construction, the removal of the recording material out of the image forming apparatus is facilitated. Further, the fixing means is provided in the opening/closing portion and moves as the opening/closing portion is opened or closed. Due to this construction, the fixing means is prevented from interfering with the removal of the recording material. The transferring means is provided in the image forming apparatus main body to achieve a reduction in the weight of the opening/closing portion.

However, an image forming apparatus constructed as described above has a problem in that the opening/closing portion does not open when a recording material stays while being nipped simultaneously by the transferring means and the fixing means.

SUMMARY OF THE INVENTION

It is an object of the present invention to provide an image forming apparatus having transferring means for effecting transfer while in contact with an image bearing member, fixing means for effecting fixing while nipping a recording material, and an opening/closing portion which is opened and closed with respect to a main body of the image forming apparatus and in which the fixing means is provided, wherein the opening/closing portion can be opened when the recording material stays while being nipped simultaneously by the transferring means and the fixing means.

It is another object of the present invention to provide an image forming apparatus including: an image bearing member; toner image forming means for forming a toner image on the image bearing member; transferring means provided in a main body of the image forming apparatus and adapted to come into contact with the image bearing member in a transfer region, for transferring the toner image on the image bearing member to a recording material; fixing means for fixing the toner image to the recording material in a fixing region while nipping the recording material; an opening/closing portion which can be opened and closed with respect to the main body and which is provided with the fixing means, the opening/closing portion allowing the recording material staying between the transfer region and the fixing region to be removed from the image forming apparatus when the opening/closing portion is in an open state and causing the fixing means to move through opening and closing of the opening/closing portion; and separating means for, when the opening/closing portion is opened, separating the transferring means, which is in contact with the image bearing member, from the image bearing member.

DESCRIPTION OF THE PREFERRED EMBODIMENTS

Figure 1:
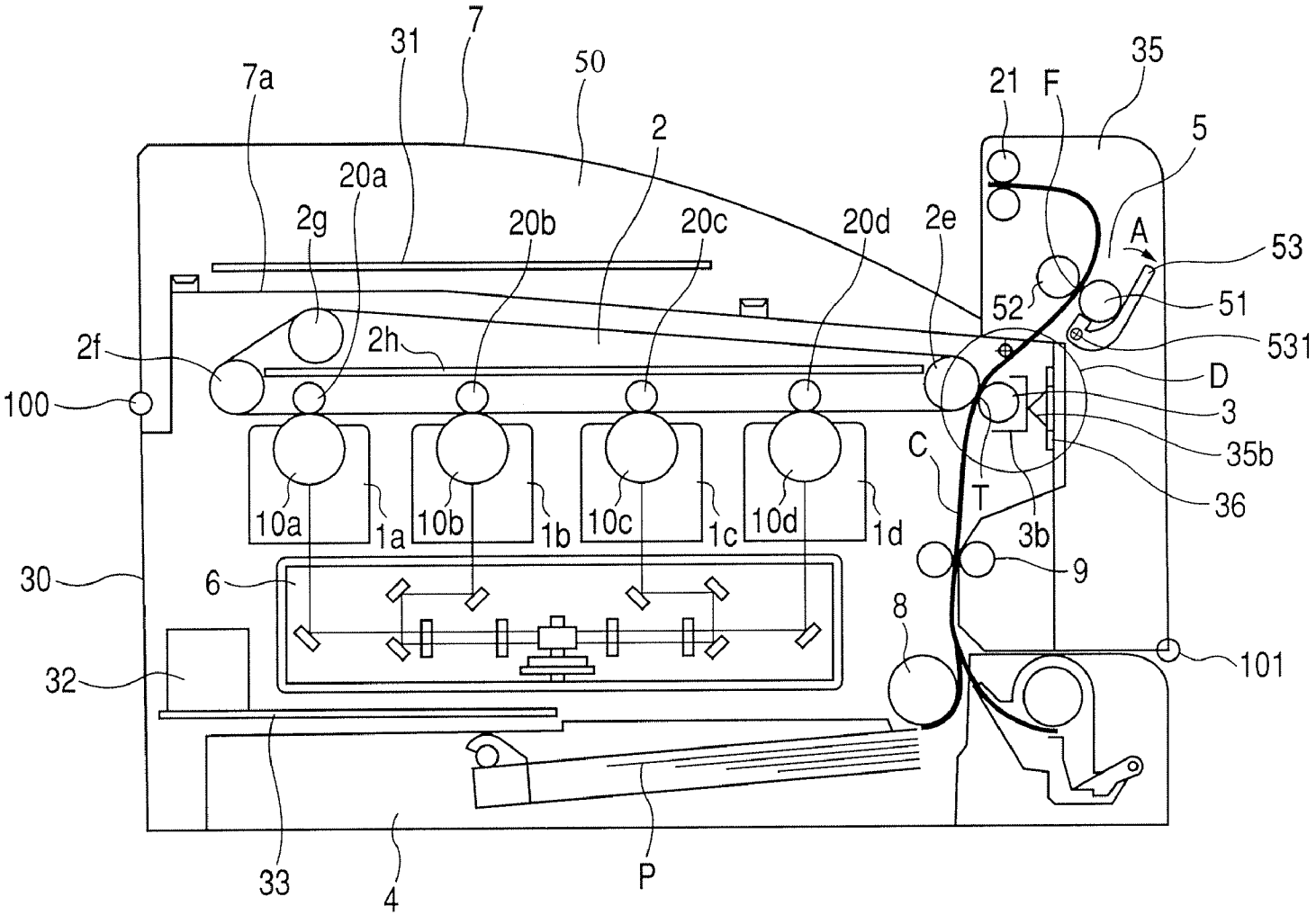
FIG. 1 is a diagram showing the general construction of an image forming apparatus according to an embodiment of the present invention.

According to the present invention, when a fixing frame 35 (opening/closing portion) of FIG. 1 is opened, a secondary transferring roller 3 (transferring means) is separated from an intermediate transferring belt 2 (image bearing member), whereby, even when a sheet P (recording material) stays while being nipped simultaneously by the secondary transferring roller 3 and a fixing device 5, the fixing frame 35 can be opened.

In the following, an embodiment of the present invention will be described in detail.

An image forming apparatus according to an embodiment of the present invention will be described with reference to the drawings. FIG. 1 is a diagram showing the general construction of the image forming apparatus of this embodiment. First, an image forming process will be described with reference to FIG. 1.

In the image forming apparatus shown in FIG. 1, four photosensitive drums 10*a* through 10*d* for forming toner images in colors of yellow, magenta, cyan, and black are arranged in parallel. Around each of the photosensitive drums 10*a* through 10*d*, there are arranged a charger, a developing device, and a cleaner, which are formed into units, namely, process cartridges 1*a* through 1*d* serving as toner image forming means. Above the process cartridges 1*a* through 1*d*, there is arranged an intermediate transferring belt 2 as an example of the image bearing member so as to be in contact with the photosensitive drums 10*a* through 10*d*.

The photosensitive drums 10*a* through 10*d* are charged by chargers (not shown), and color-decomposed optical images in yellow, magenta, cyan, and black are subjected to exposure by an exposure device 6 to form latent images for yellow, magenta, cyan, and black on the photosensitive drums 10*a* through 10*d*. The latent images are developed by developing devices to thereby form toner images in yellow, magenta, cyan, and black on the photosensitive drums 10*a* through 10*d*.

As the photosensitive drums 10*a* through 10*d* rotate, the toner images reach primary transfer positions where the photosensitive drums 10*a* through 10*d* are in contact with the intermediate transferring belt 2. The toner images are successively transferred to the intermediate transferring belt 2 by primary transferring rollers 20*a* through 20*d* respectively opposed to the photosensitive drums 10*a* through 10*d*.

Sheets P accommodated in a feed cassette 4 are sent out one by one by a pickup roller 8 as an example of feeding/conveying means, and, after being synchronized by registration rollers 9, each of the sheets P is conveyed to a nip portion serving as transfer means composed of a secondary transferring roller 3 and an intermediate transferring belt 2, the toner images on the intermediate transferring belt 2 collectively undergoing secondary transfer in a transfer region T. Thereafter, the sheet P to which the toner images have been transferred is conveyed to the fixing device 5 as an example of fixing means, where the toner images are fixed in the fixing region F under heat and pressure. The fixing device 5 has a roller 51 and a roller 52 (roller pair) in contact with each other in the fixing region F and adapted to convey the sheet P while nipping the same.

Further, by rotating a separating lever (fixing member separating means) 53 provided on the roller 52 in the direction of the arrow A, the roller 52 is separated from the roller 51. Through fixing, the toners of different colors are melted and mixed with each other before being fixed to the sheet P to form a full-color print image, and then the sheet P is discharged onto a discharging tray 7 as an example of discharging/stacking means by discharging/conveying means 21 provided on the downstream side of the fixing device 5.

The arrangement of the various portions in the apparatus will be described. In the image forming apparatus of this embodiment, there are arranged, as from the lower portion of a main body portion 30, the feed cassette 4, the exposure device 6, the process cartridges 1*a* through 1*d*, the intermediate transferring belt 2, and the discharging tray 7. Further, inside the main body portion 30, there are arranged a stationary power source 32, and a main electrical component board 33 for controlling the image forming apparatus as a whole. Further, an electrical component board 31 for applying a transfer bias to the primary transferring rollers 20*a* through 20*d* and the secondary transferring roller 3, is arranged above the intermediate transferring belt 2 and below the discharging tray 7. The discharging tray 7 exhibits a curved surface inclined upwardly from the upstream side toward the downstream side with respect to the direction in which discharge is effected from the discharging/conveying means 21, and the electrical component board 31 is arranged inside the space formed between the discharging tray 7 and the intermediate transferring belt 2. As shown in FIG. 1, at the time of installation of the image forming apparatus, the fixing device 5 is arranged above the secondary transferring roller 3.

Figure 2:
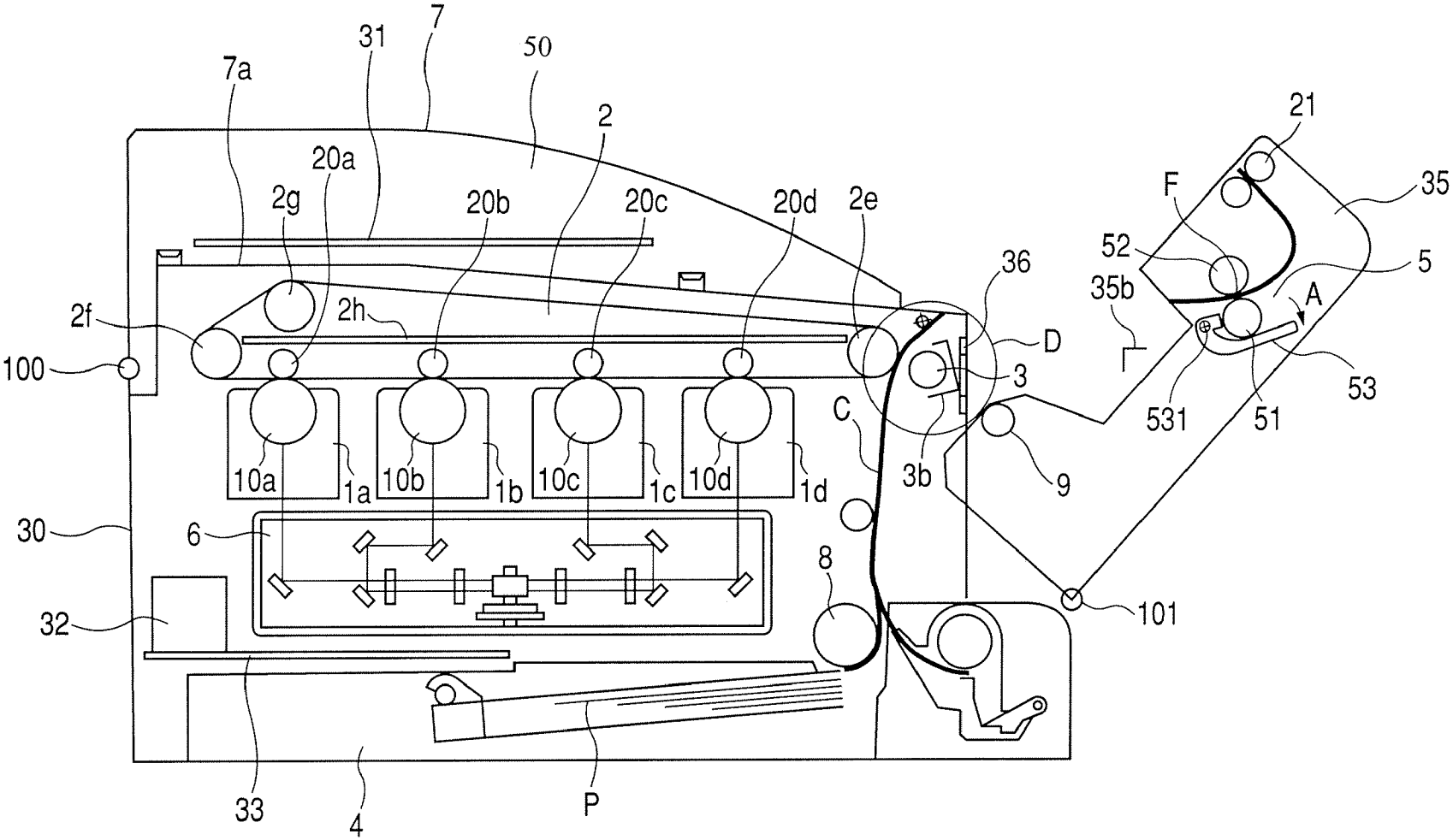
FIG. 2 is a sectional view of the image forming apparatus with a first rotating portion open.
Figure 3:
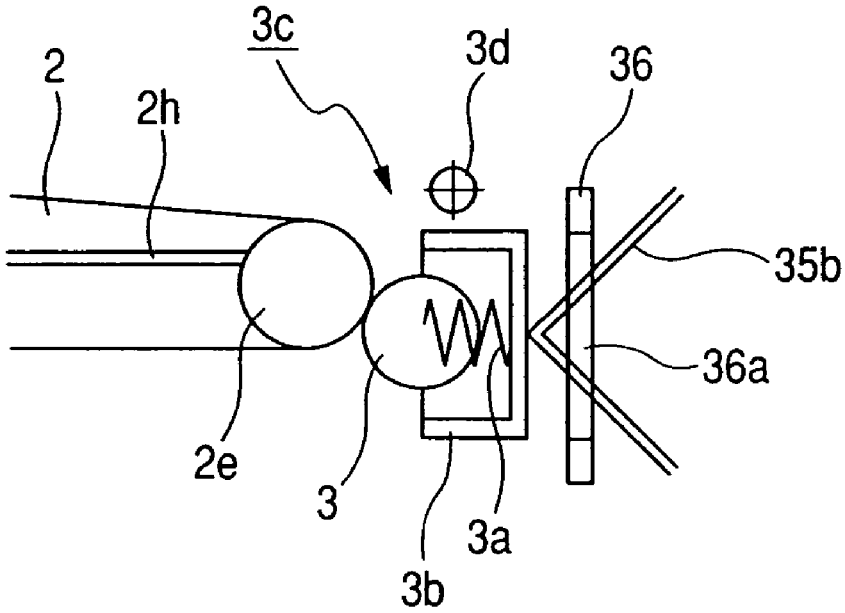
FIG. 3 is a diagram illustrating a portion in the vicinity of secondary transferring means in a state in which the secondary transferring means is in contact with an image bearing member.

Next, the features of this embodiment will be described. FIG. 2 is a sectional view showing a state in which a first rotating portion is open. FIG. 3 is a diagram illustrating the construction of the portion in the vicinity of secondary transferring means and showing, in particular, how a wire spring 35*b* provided on a fixing frame 35 pressurizes a holder 3*b* holding the secondary transferring roller 3 to keep the secondary transferring roller 3 in contact with the intermediate transferring belt 2.

Figure 4:
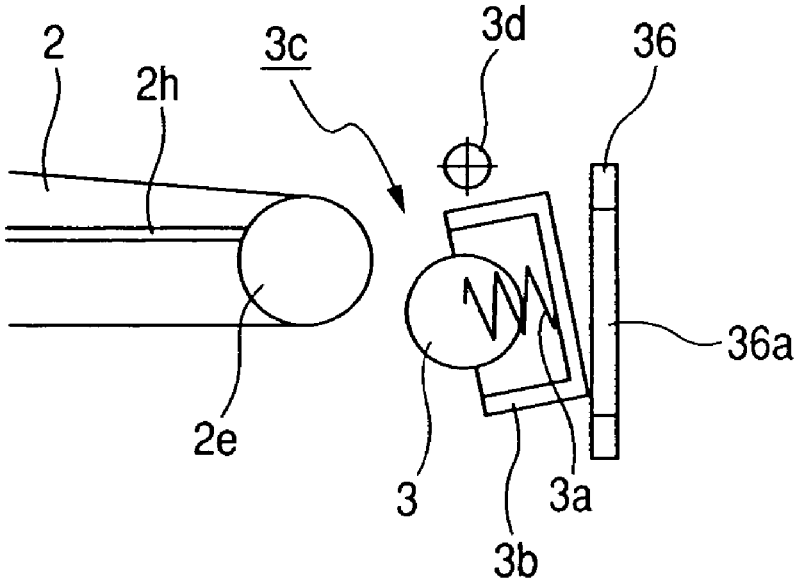
FIG. 4 is a diagram showing a state in which the secondary transferring means is separated from the image bearing member.

FIG. 4 is a diagram showing a state in which the holder 3*b* holding the secondary transferring roller 3 is not pressurized by the wire spring 35*b* provided on the fixing frame 35, with the secondary transferring roller 3 being separated from the intermediate transferring belt 2.

Figure 5:
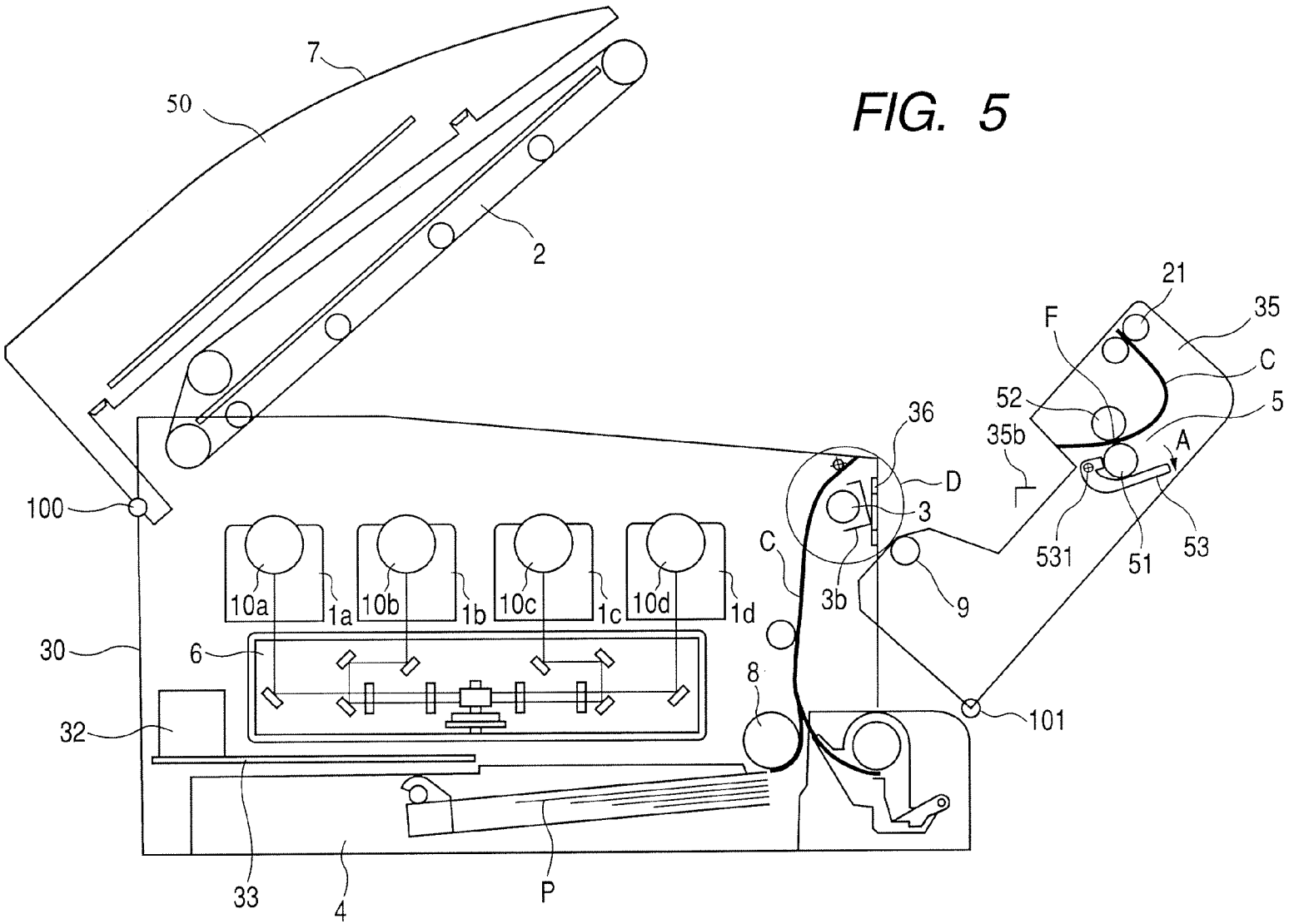
FIG. 5 is a sectional view of the image forming apparatus with a second rotating portion open.
Figure 6:
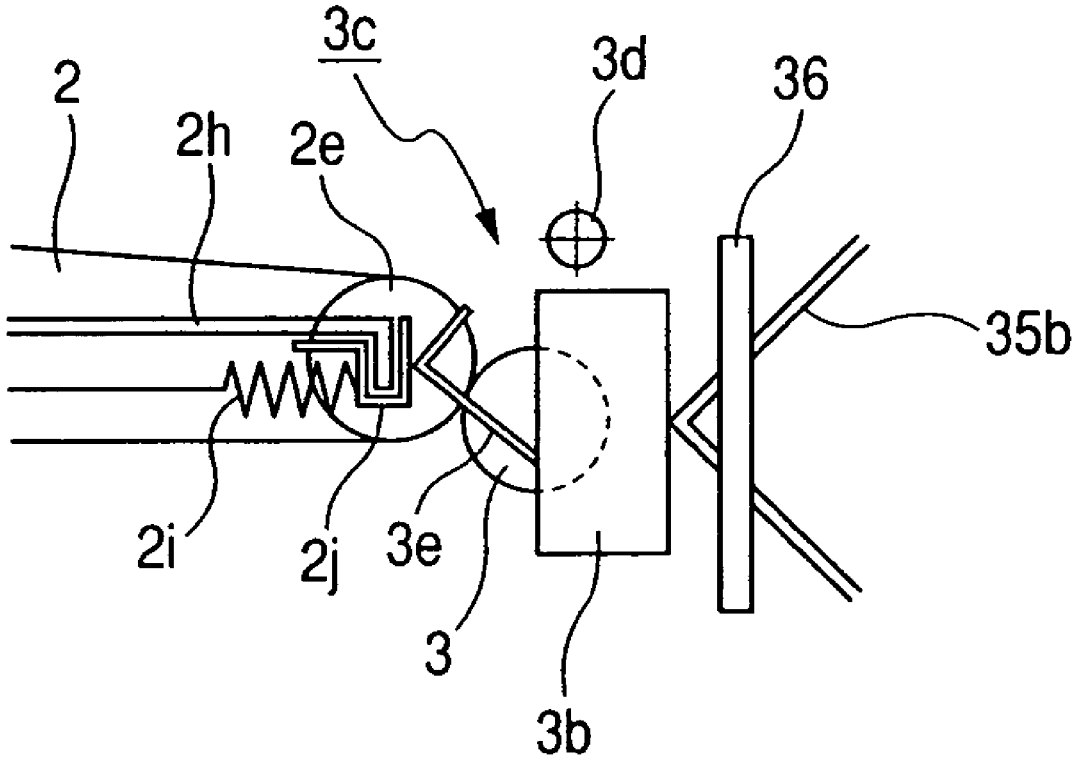
FIG. 6 is a diagram illustrating a power supply route for the secondary transferring means.

FIG. 5 is a sectional view showing a state in which a second rotating portion is open, and FIG. 6 is a diagram illustrating the power supply route for the secondary transferring means.

As shown in FIG. 2, arranged in the fixing frame 35 as an example of the rotating portion (opening/closing portion) are the fixing device 5 and a part of a sheet path C as an example of the sheet conveying path, and the fixing frame 35 rotates toward the apparatus side surface using an axle 101 provided on the main body portion 30 as the fulcrum, thus allowing opening and closing. Thus, when the sheet P sent out from the cassette 4 by the pickup roller 8 undergoes jamming halfway through the conveyance, and stays within the sheet path C, or when the sheet P undergoes jamming within the fixing device 5 and stays between the transfer region T and the fixing region F, jamming-treatment is effected by keeping the fixing frame 35 open. At this time, since the fixing frame 35 is in the open state, the fixing device 5 is moved from the position where it fixes a toner image to the sheet P while nipping and conveying the sheet P.

FIG. 3 is a diagram showing a range D in the vicinity of the secondary transferring roller 3 in FIG. 2. As shown in FIG. 3, the secondary transferring roller 3 is rotatably held by the holder 3*b*, and is biased toward the intermediate transferring belt 2 by a compression spring 3*a*. The secondary transferring roller 3, the compression spring 3*a*, and the holder 3*b* constitute a secondary transferring roller unit 3*c*. Further, the secondary transferring roller unit 3*c* is mounted to the apparatus main body by an axle 3*d* so as to be capable of rocking. The axle 3*d* is situated at a position such that, when, upon opening the fixing frame 35, the secondary transferring roller unit 3*c* is placed in a substantially upright state due to its own weight, the secondary transferring roller 3 is separated from the intermediate transferring belt 2. As shown in FIG. 3, when the fixing frame 35 is in the closed state, the wire spring 35*b* provided on the fixing frame 35 presses the secondary transferring roller unit 3*c*, and the secondary transferring roller 3 comes into contact with the intermediate transferring belt 2.

Conversely, when the fixing frame 35 is in the open state, the wire spring 35*b* does not press the secondary transferring roller unit 3*c*, as shown in FIG. 4, and the secondary transferring roller 3 is separated from the intermediate transferring belt 2.

Further, between the secondary transferring roller unit 3*c* and the fixing frame 35, there is arranged a reinforcement member 36 connecting a main body left-hand side plate and a main body right-hand side plate (not shown) to each other to constitute a part of the main body frame. That is, the upper end of the fixing frame 35 is higher than the upper surface of the main body portion 30, and the fixing frame 35 is supported by the axle 101 at the lower end so as to be rotatable with respect to the main body portion (main body) 30. Thus, when the fixing frame 35 is opened, a large opening is formed in the main body portion 30, and the main body frame would suffer a shortage of strength. In view of this, the reinforcement member 36 is provided to thereby compensate for the shortage of strength of the main body frame.

The reinforcement member 36 has an opening 36*a* at either longitudinal end thereof. On the other hand, fixed to the portion of the fixing frame 35 opposed to the opening 36*a* of the reinforcement member 36 is an L-shaped wire spring 35*b* as an example of separating means. When the fixing frame 35 is in the closed state, the wire spring 35*b* biases the holder 3*b* through the opening 36*a*, and causes the secondary transferring roller unit 3*c* to rotate around the axle 3*d* to bring the secondary transferring roller 3 into contact with the intermediate transferring belt 2. Conversely, when the fixing frame 35 is placed in the open state, the secondary transferring roller 3 is separated from the intermediate transferring belt 2.

Due to the above construction, when the fixing frame 35 is opened as shown in FIG. 2, the secondary transferring roller 3 is separated from the intermediate transferring belt 2, whereby the sheet path C is opened. Thus, when the sheet P undergoes jamming before or after the nip portion between the secondary transferring roller 3 and the intermediate transferring belt 2, the jamming can be easily removed.

Further, when the sheet P stays in the fixing device 5 to cause jamming, by opening the fixing frame 35, the secondary transferring roller 3 is separated from the intermediate transferring belt 2 to open the sheet path C, so that it is possible for the sheet P to be drawn out while held by the fixing device 5. That is, any sheet P staying in the fixing region F is nipped by the roller 51 and the roller 52 when the fixing frame 35 is switched over from the closed state to the open state.

Figure 7:
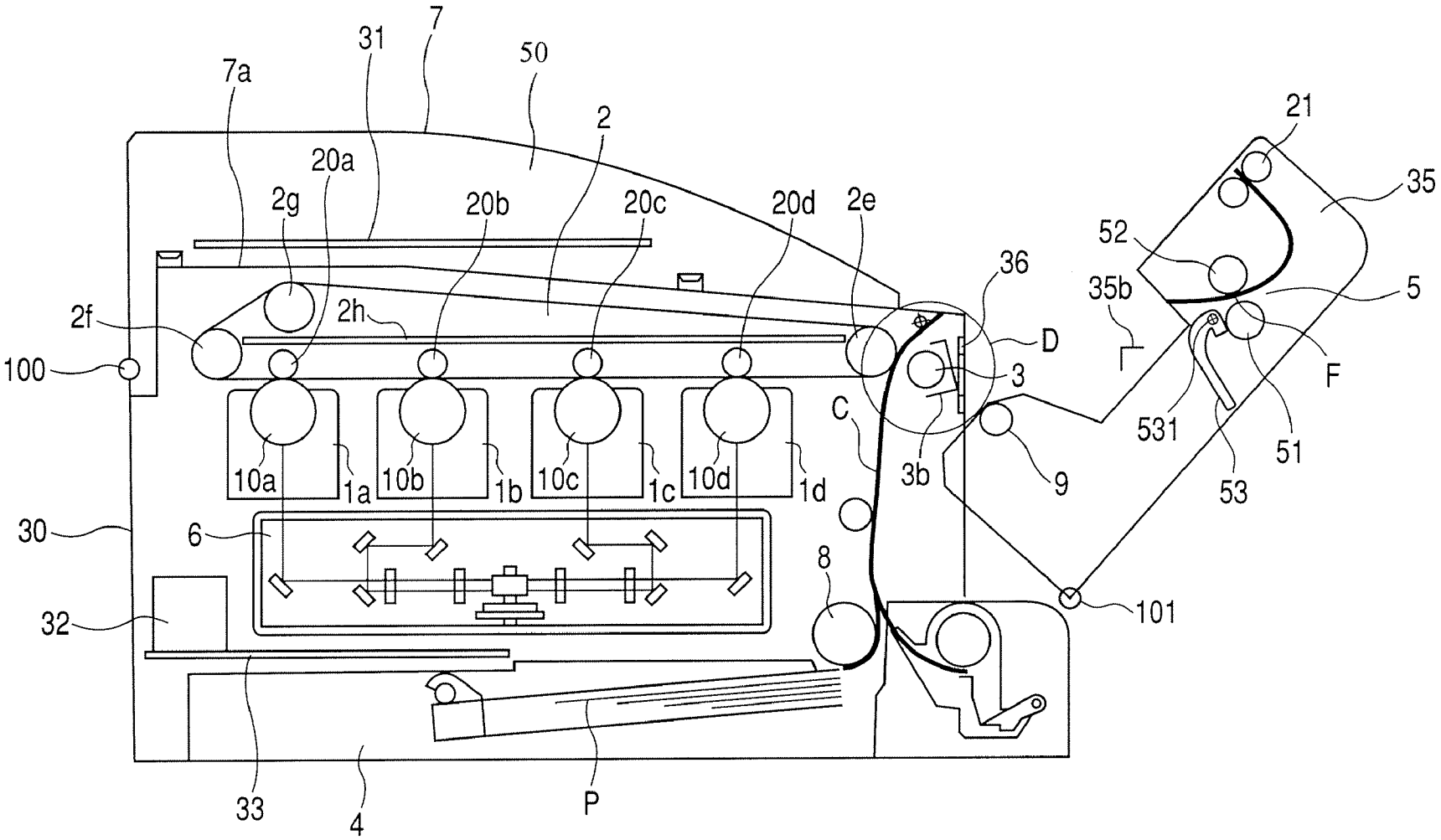
FIG. 7 is a diagram showing a state in which the first rotating portion is open, with rollers provided in a fixing device separated.

Further, as shown in FIG. 5, by manipulating the roller separating lever 53 provided in the fixing device 5, the rollers 51 and 52 in contact with each other are separated. The separating lever 53 rotates in the direction of the arrow A using a support point 531 as a fulcrum, separating the rollers 51 and 52 from each other. FIG. 7 shows the rollers 51 and 52 as separated from each other.

Figure 9A:
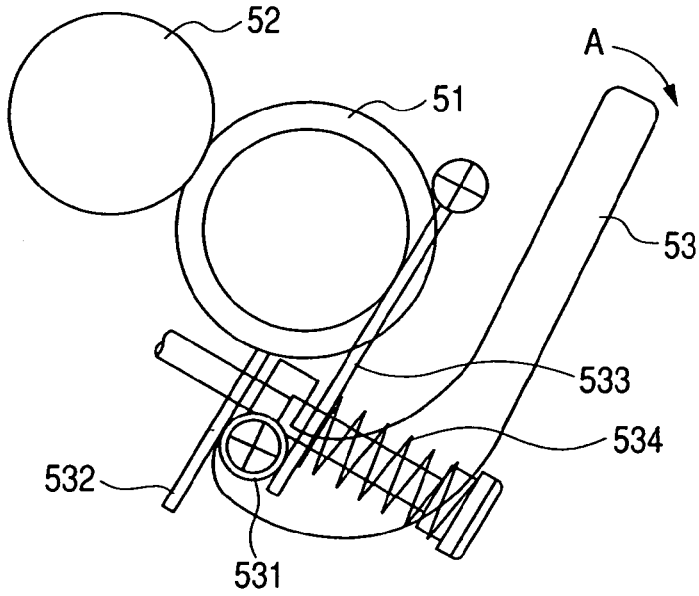
FIGS. 9A and 9B are diagrams showing a means for separating the roller 51 and the roller 52 from each other.
Figure 9B:
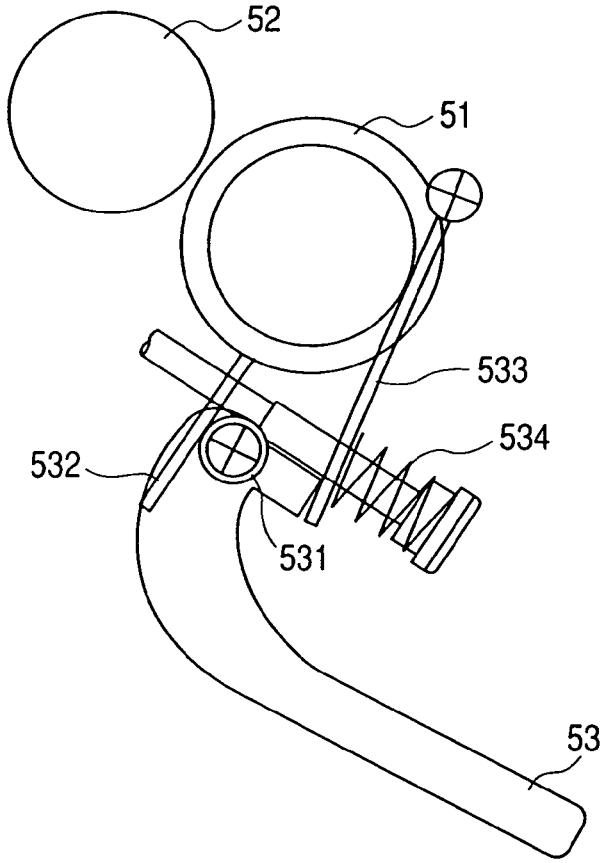

In FIGS. 9A and 9B, a means for separating the rollers 51 and 52 from each other is shown in detail. The means for separating includes the separating lever 53, the support point 531, a support member 532, a pressure lever 533 and a spring 534.

When the separating lever 53 is placed in a position as shown in FIG. 9A, the pressure lever 533 presses the roller 51 towards the roller 52 by pressure force given from the spring 534 supported by the support member 532. As a result, the roller 51 is in contact with the roller 52.

To the contrary, when the separating lever 53 is placed in a position as shown in FIG. 9B, pressure force which the pressure lever 533 is given from the spring 534 is released. At this time, the roller 51 is not pressed by the pressure lever 533. As a result, the roller 51 moves by its own weight, and the roller 51 separates from the roller 52. When the rollers 51 and 52 are separated from each other, jamming of the sheet P remaining in the fixing device 5 can be easily removed.

Further, positioning is effected on the secondary transferring roller unit 3*c* using the axle 3*d* provided in the main body portion 30 as a fulcrum, so that it is possible to ensure accurate alignment of the secondary transferring roller unit 3*c* with the intermediate transferring belt 2 placed in position in the main body portion 30 as described below, and defective conveyance of the sheet P, such as skew conveying or skew feeding, is suppressed, thus stabilizing the conveyance of the sheet P.

Further, as shown in FIG. 5, the discharging tray 7 is formed integrally with a discharging frame 7*a* as a discharging unit 50 as an example of the second rotating portion. The discharging unit 50 is supported so as to be rotatable with respect to the apparatus main body using an axle 100 provided on the side opposite to the fixing frame 35 as a fulcrum. The intermediate transferring belt 2 is engaged with the discharging unit 50 by an engagement portion (not shown). Thus, when the discharging unit 50 is opened by using the axle 100 provided on the main body portion 30 as the fulcrum, the intermediate transferring belt 2 is opened in synchronism with the discharging unit 50. Thus, when replacing the process cartridges 1*a* through 1*d*, which are consumable articles, access to the process cartridges 1*a* through 1*d* can be gained solely by a single operation of opening the discharging unit 50.

While in the above example the intermediate transferring belt 2 is rotated in synchronism with the discharging unit 50, it is also possible for the intermediate transferring belt 2 to share the axle 100 serving as the rotation fulcrum with the discharging unit 50 and to rotate singly, or it is also possible to provide the rotation fulcrums for the intermediate transferring belt 2 and the discharging unit 50 separately, allowing each of the discharging unit 50 and the intermediate transferring belt 2 to rotate singly.

Further, the intermediate transferring belt 2 is suspended by suspension rollers 2*e*, 2*f*, and 2*g*, and there is affianced a transfer frame 2*h* for supporting the suspension rollers 2*e* through 2*g*, the primary transferring rollers 20*a* through 20*d*, (See FIG. 1) etc. Formed in the transfer frame 2*h* is a power supply route for applying transfer bias to the secondary transferring roller 3 through a combination of a power supply electric wire routed within the main body portion 30 from the stationary power source 32, a contact plate, a wire material, etc. In FIG. 6, a compression spring 2*i* is pressed against a contact plate 2*j* by a wire material and a wire material end portion within the transfer frame 2*h* to thereby form a power supply route.

On the other hand, a wire spring 3*e* as an example of the contact portion for the power supply route is fixed to the secondary transferring roller unit 3*c*, with one end of the wire spring 3*e* abutting the shaft portion peripheral surface of the secondary transferring roller 3. The other end portion of the wire spring 3*e* has an L-shaped configuration, and abuts the surface of the contact plate 2*j* in the transfer frame 2*h* on the side opposite to the compression spring 2*i* exerting pressurization. Thus, when the fixing frame 35 is closed, the secondary transferring roller unit 3*c* is placed in position by the wire spring 35*b*, and the V-shaped end portion of the wire spring 3*e* is pressurized by the contact plate 2*j* to thereby form the transfer bias power supply route leading to the secondary transferring roller 3. Conversely, when the fixing frame 35 is opened, the power supply route to the intermediate transferring belt 2 is opened (cut off). That is, when the fixing frame 35 is opened in order to perform jamming treatment, etc., the power supply to the secondary transferring roller 3 is cut off instantaneously, so that safety for the operator is ensured.

In brief, the rotating portion serves two purposes: to open the sheet conveying path for jamming treatment, and to perform replacement of the inner unit. It is necessary that the intermediate transferring belt and the secondary transferring roller, which are on the apparatus main body side, abut each other with high positional accuracy.

In view of this, according to the present invention, the fixing device is arranged on the rotating portion side, and the secondary transferring roller is arranged on the apparatus main body side, whereby it is possible to ensure the requisite positional accuracy for the secondary transferring roller while securing the ease of jamming treatment.

Further, the means for bringing the secondary transferring roller into and out of contact with the secondary transferring belt is provided in the rotating portion such that the secondary transferring roller is brought into or out of contact as the rotating portion is opened or closed, whereby it is possible to open the sheet conveying path although the secondary transferring roller is arranged on the apparatus main body side, thus facilitating jamming treatment. Due to the provision of the fixing device in the rotating portion, when any sheet is staying in the fixing device, that sheet follows the fixing device when the rotating portion is opened. Thus, jamming treatment can be conducted easily solely by canceling the pressurization of the fixing device.

Incidentally, the opening of the rotating portion is likely to suffer a shortage of strength; thus, when a heavy device like the fixing device is arranged in the rotating portion, the main body frame suffers a shortage of strength. In particular, when, as in the above embodiment, the second rotating portion has its axle on the side opposite to the rotating portion, the opening is so much the larger, resulting in a shortage of strength in the main body frame. On the other hand, it is impossible to provide a reinforcement member within the movement range for the rotating portion. Since the secondary transferring roller is left on the main body side, the position of the secondary transferring roller cannot be in the movement range for the rotating portion, which must be of a retracted configuration.

In view of this, according to the present invention, the reinforcement member is arranged between the secondary transferring roller and the rotating portion, whereby it is possible to minimize the retracted portion of the rotating portion. Thus, it is possible to efficiently provide the reinforcement member in the opening of the rotating portion and out of the movement range thereof, making it possible to achieve a reduction in the size of the apparatus while securing the requisite strength of the rotating portion. Further, by arranging the fixing device supported by the rotating portion so as to overlap the secondary transferring roller from above, it is possible to achieve a reduction in the size of the image forming apparatus.

Further, by arranging the reinforcement member between the secondary transferring roller and the rotating portion, that is, in the vicinity of the secondary transferring roller, it is possible to prevent deformation of the portion of the main body frame near the secondary transferring roller even if the weight of the rotating portion is large, and, further, it is possible to secure high positional accuracy for the secondary transferring roller.

Figure 8:
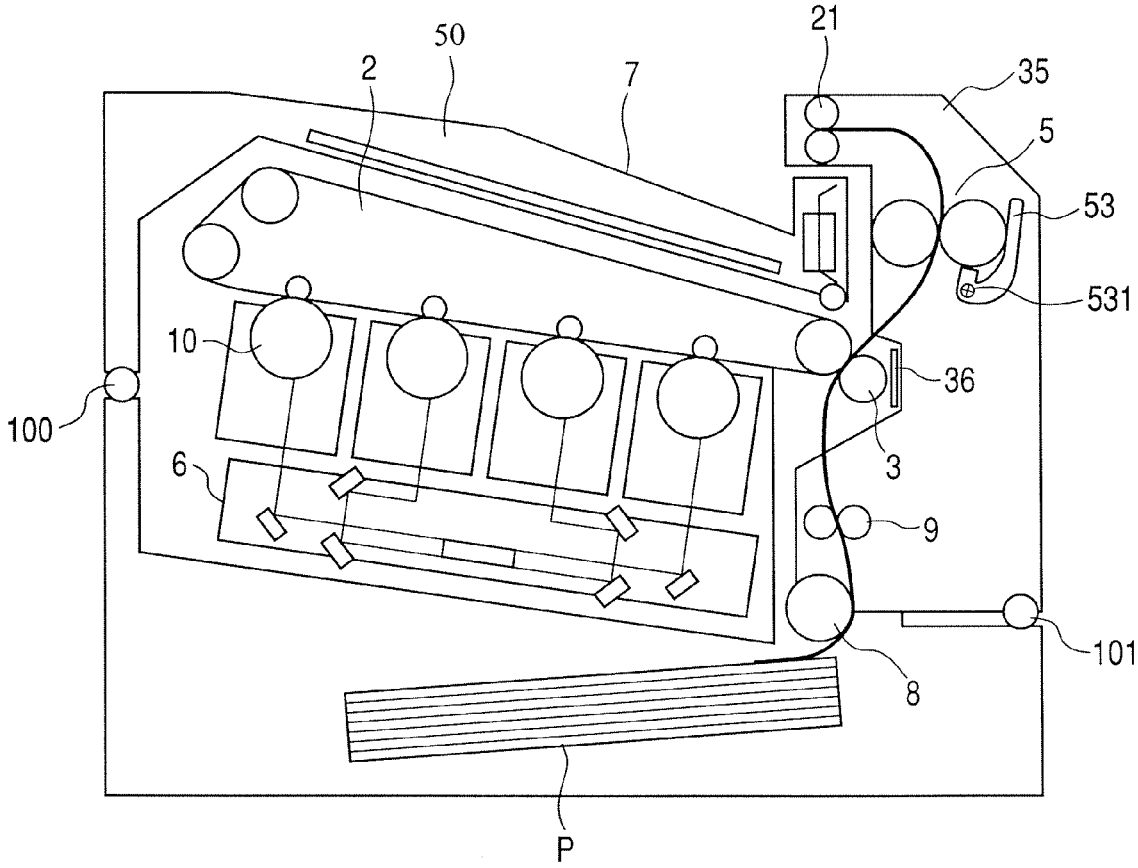
FIG. 8 is a diagram illustrating the construction of an image forming apparatus according to another embodiment.

While in the above-described embodiment the intermediate transferring belt 2 is arranged substantially horizontally, it is also possible, as shown in FIG. 8, to arrange the intermediate transferring belt 2 such that it is inclined downwardly toward the secondary transferring roller 3. In this case, the space near the secondary transferring roller 3 is diminished; however, when, as described above, the reinforcement member 36 is fixed to the main body left-hand side plate and the main body right-hand side plate, and the secondary transferring roller 3 is supported by the main body, it is possible to secure the requisite rigidity of the main body frame, and the ease of jamming treatment for the sheet P is not adversely affected at all.

This application claims priority from Japanese Patent Application No. 2004-192778 filed on Jun. 30, 2004, which is hereby incorporated by reference herein.

What is claimed is:

1. An image forming apparatus comprising:

an image bearing member for bearing a toner image;

a transferring member adapted to come into contact with the image bearing member, for static electrically transferring the toner image on the image bearing member to a recording material;

a contact member contacting said transferring member;

a power supply for applying a transfer voltage to said transferring member through said contact member;

an apparatus main body unit including at least said image bearing member, said transferring member, said contact member, and said power supply;

fixing means for fixing the toner image transferred from said image bearing member to said recording material;

an opening unit including said fixing means and openable relative to said apparatus main body unit so as to open a recording material conveyance path between said transferring member and said fixing means;

separating means for separating said transferring member from said image bearing member in synchronism with an opening operation of said opening unit relative to said apparatus main body unit; and disconnecting means for disconnecting said contact member from said transferring member in synchronism with the opening operation of said opening unit relative to said apparatus main body unit.

2. An image forming apparatus according to claim 1, wherein the fixing means has a pair of fixing members in contact with each other in a fixing region to nip the recording material, and wherein the recording material staying in the fixing region is nipped by the fixing members during an opening operation of said opening unit.

* * * * *

UNITED STATES PATENT AND TRADEMARK OFFICE

CERTIFICATE OF CORRECTION

PATENT NO. : 7,302,209 B2
APPLICATION NO. : 11/166101
DATED : November 27, 2007
INVENTOR(S) : Kurita It is certified that error appears in the above-identified patent and that said Letters Patent is hereby corrected as shown below:

COLUMN 4:
Line 23, "jamming-treatment" should read --jamming treatment--.

COLUMN 6:
Line 25, "affianced" should read --arranged--.

Signed and Sealed this

Eighth Day of July, 2008

JON W. DUDAS
*Director of the United States Patent and Trademark Office*